US006889461B2

(12) United States Patent
Vignaroli et al.

(10) Patent No.: US 6,889,461 B2
(45) Date of Patent: May 10, 2005

(54) RECOIL PAD, PARTICULARLY FOR FIREARMS

(75) Inventors: Marco Vignaroli, Perugia (IT); Michele Lani, Urbania (IT)

(73) Assignee: Benelli Armi S.p.A., Urbino (IT)

( * ) Notice: Subject to any disclaimer, the term of this patent is extended or adjusted under 35 U.S.C. 154(b) by 0 days.

(21) Appl. No.: 10/626,016

(22) Filed: Jul. 24, 2003

(65) Prior Publication Data

US 2004/0144011 A1 Jul. 29, 2004

(30) Foreign Application Priority Data

Sep. 5, 2002 (IT) ..... MI2002A1887

(51) Int. Cl.[7] ..... F41C 23/20
(52) U.S. Cl. ..... 42/74; 42/73
(58) Field of Search ..... 42/73, 74

(56) References Cited

U.S. PATENT DOCUMENTS 4,551,937 A * 11/1985 Seehase ..... 42/74
6,305,115 B1 10/2001 Cook ..... 42/74
6,594,935 B2 * 7/2003 Beretta ..... 42/74

FOREIGN PATENT DOCUMENTS

| | | | |
|---|---|---|---|
| BE | 395140 A | 3/1933 | ..... 42/74 |
| DE | 297 09 576 U | 10/1997 | |
| EP | 1122507 A3 | 8/2001 | ..... 42/74 |
| EP | 1122507 A2 | 8/2001 | ..... 42/74 |
| WO | WO 02/46681 | 6/2002 | |

* cited by examiner

*Primary Examiner*—Stephen M. Johnson
(74) *Attorney, Agent, or Firm*—R. Neil Sudol; Henry D. Coleman; William J. Sapone

(57) ABSTRACT

A recoil pad, particularly for firearms, which can be fixed detachably to the stock of the firearm and includes a plastic base and a rear member made of deformable material, preferably polyurethane gel, which is rigidly coupled to the base and is adapted to dissipate the energy transferred to the shoulder by the recoil of the firearm upon firing. The recoil pad has two pins for snap fixing the pad to the stock of the rifle.

10 Claims, 3 Drawing Sheets

RECOIL PAD, PARTICULARLY FOR FIREARMS

BACKGROUND OF THE INVENTION

1. Field of the Invention

The present invention relates to a recoil pad particularly for firearms.

2. Description of the Prior Art

The butt pad or recoil pad is an accessory which was initially provided to protect the rear face of the stock of a firearm against impacts and to prevent its chipping, especially in the lower sharp corner.

Another important function of the butt pad is to cushion the forces generated by the recoil of a firearm, particularly of a smoothbore or rifle, and for this purpose recoil pads have been proposed which are formed by an elastomeric material, such as rubber, and undergo elastic deformation in order to absorb the forces at least partially, preventing them from discharging completely onto the shoulder of the shooter.

Many types of pads have been proposed, but the most common are constituted by a main body, made of elastomeric material, which is fastened to the rear face of a front layer made of relatively hard and rigid material which has openings through which screws pass in order to associate the butt pad with the stock.

Conventional recoil pads may also solve other problems linked to the operations of the firearm from a purely ballistic standpoint, i.e., problems linked to the use of the firearm, for example in sports contests.

In general, the recoil pads that are most effective from the point of view of technical performance are also constructively very complicated and expensive, while recoil pads that are constructively simpler and cheaper do not offer a sufficient technical performance.

SUMMARY OF THE INVENTION

The aim of the present invention is to provide a recoil pad that overcomes the drawbacks of the cited known art.

An object of the invention is to provide a recoil pad that is capable of absorbing effectively the forces generated by the recoil of the firearm.

A further object of the invention is to provide a recoil pad that is simple from the constructive standpoint.

A further object is to provide a recoil pad that can be applied to the firearm and optionally replaced rapidly and easily.

This aim and these and other objects that will become better apparent hereinafter are achieved by a recoil pad as claimed in the appended claims.

Further characteristics and advantages of the invention will become better apparent from the description of preferred but not exclusive embodiments thereof, illustrated only by way of non-limitative example in the accompanying drawings.

DESCRIPTION OF THE PREFERRED EMBODIMENTS OF THE INVENTION

Figure 2:
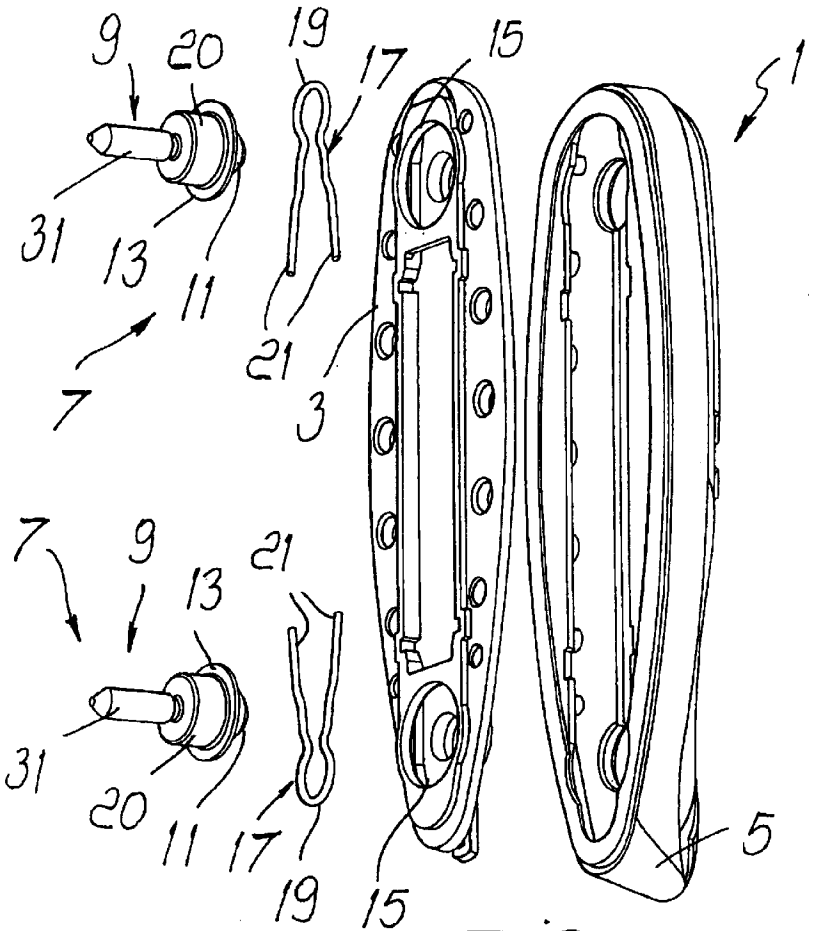
FIG. 2 is an exploded perspective view of the recoil pad.
Figure 1:
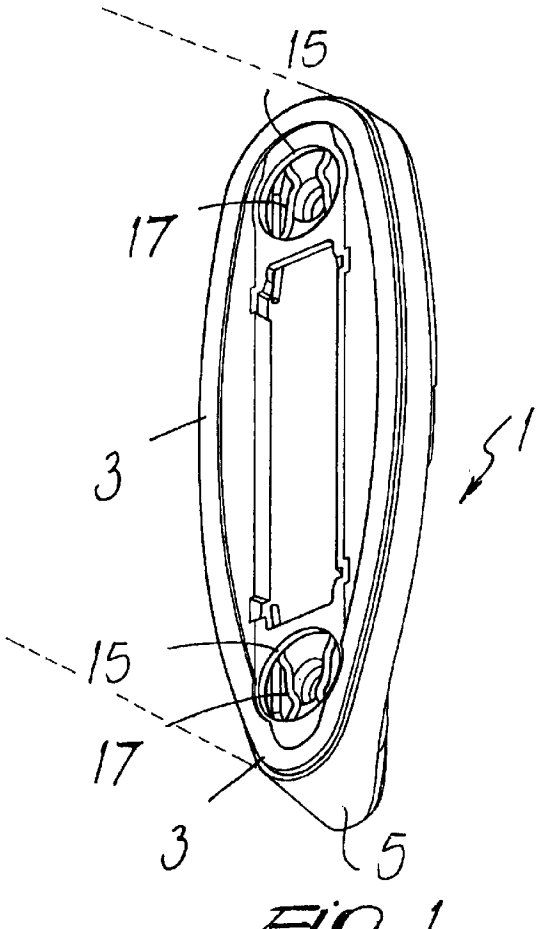
FIG. 1 is a front perspective view of a recoil pad according to the invention.
Figure 3:
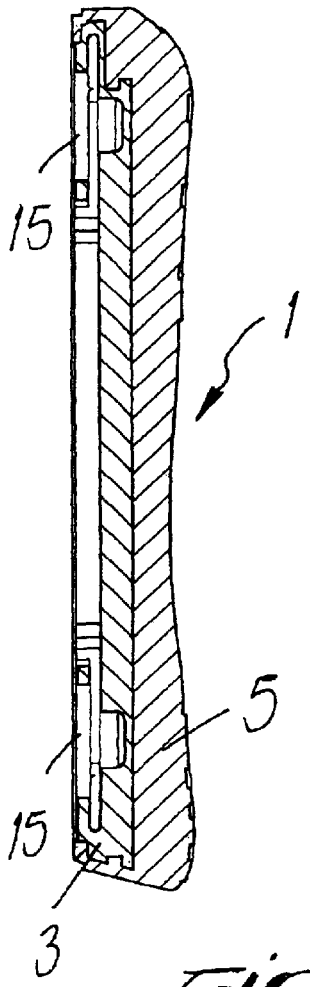
FIG. 3 is a sectional side elevation view of the recoil pad.

With reference to the cited figures, a recoil pad according to a first aspect of the invention is shown in FIGS. 1 to 5 and is generally designated by the reference numeral 1.

The recoil pad 1 includes a base 3, which can be fixed to the stock of a firearm such as a rifle or shotgun and is made of rigid material, preferably plastics.

The base has an elongated shape whose contour substantially duplicates the shape of the stock of the rifle with which it is meant to mate.

A rear member 5 is rigidly coupled to the base 3 and is made of deformable material, preferably polyurethane gel, so as to form a single nondetachable member, forming a substantially monolithic structure.

The rear member 5 is preferably rigidly coupled to the base 3 by way of a process that consists of pouring the material into a cavity shaped like the recoil pad.

The material of the member 5 is preferably a polyurethane gel or polyurethane-based gel with high shock-absorbing power, preferably a polyurethane gel with densities that can vary according to the degree of shock absorption that one wishes to give the butt plate.

Preferably, before pouring the material into the mold cavity, the cavity is coated with a protective coating that will be applied to the outer surface of the butt plate, with a protective function.

The member 5 has an outer surface that is contoured so as to facilitate resting on the shoulder of the shooter when he or she brings the rifle to the firing position to shoot.

The outer surface of the member 5 is shaped so as to adapt anatomically to the shape of the shoulder, particularly to the region of the pectoral muscles and the deltoid muscle.

The recoil pad 1 according to the invention includes a snap-acting means 7 for fastening it to the stock of the rifle.

According to a first embodiment, shown in FIGS. 1 to 5, the snap-acting means 7 comprise two pins 9, which are rigidly coupled to the stock.

Each one of the pins 9 in fact has a fixing member 31, for example of the screw type, which can engage in the rear part of the stock of the firearm.

The pin 9 has a mushroom-shaped head 11 formed on a shoulder 13 that protrudes from a cylindrical body 20. The mushroom-shaped head 11 of each pin 9 protrudes from the rear face of the stock, when the pins are rigidly coupled to it, and can be inserted in a hole 15 formed in the base 3.

The insertion of the mushroom-shaped head 11 in the hole 15 occurs with a snap action, by way of the presence of elastic members 17, constituted by a fork-shaped spring that includes, as shown in FIG. 2, a substantially circular portion 19 that ends with two substantially longitudinal arms 21.

Figure 4:
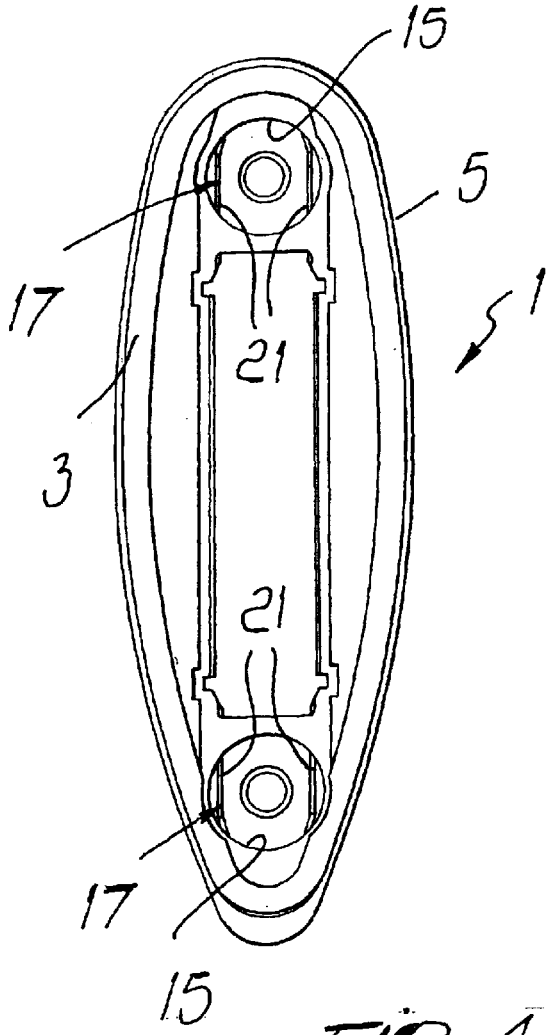
FIG. 4 is a front elevation view of the recoil pad.
Figure 5:
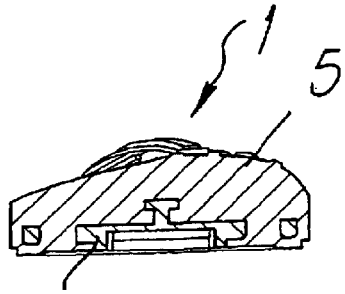
FIG. 5 is a sectional plan view of the recoil pad.

The spring 17 is arranged in a receptacle formed inside the base 3 at the holes 15, so that the arms 21 face the hole 15, as shown more clearly in FIG. 4.

In practice, when the recoil pad 1 is pressed onto the stock of the rifle to associate it therewith, the pins 9 are inserted in the corresponding holes 15, so that the mushroom-shaped head 11 engages the arms 21 of the fork-shaped spring 17.

During insertion, the arms 21 open elastically and then close with a snap action on the mushroom-shaped head 11, locking the recoil pad 1 in position.

Figure 7:
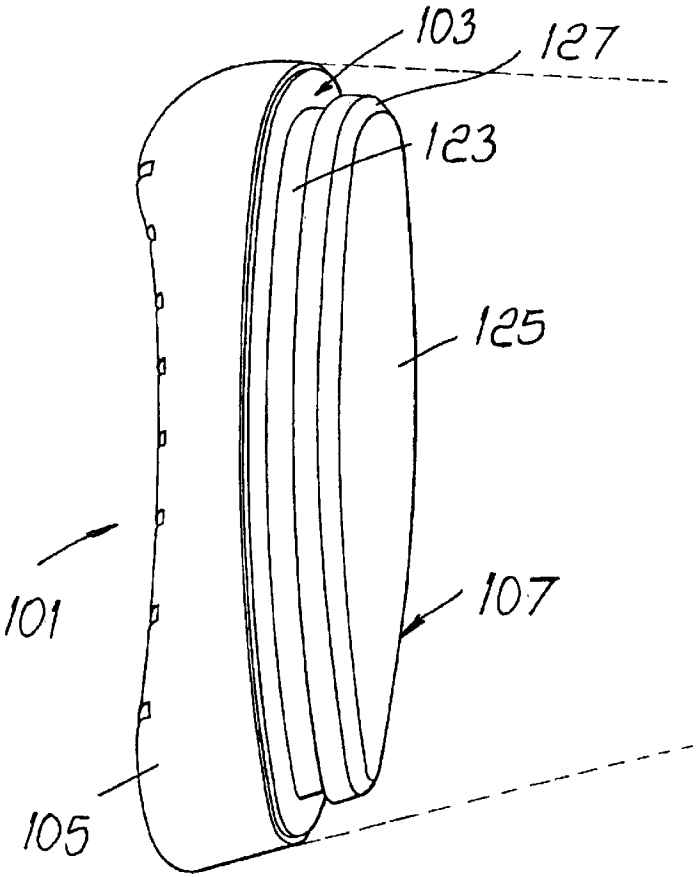
FIG. 7 is a front perspective view of the recoil pad of FIG. 6.
Figure 6:
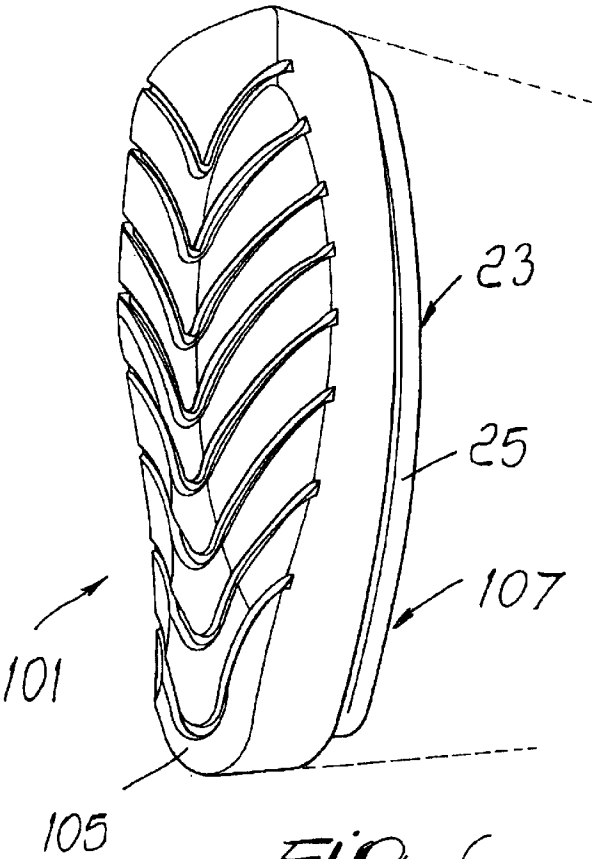
FIG. 6 is a rear perspective view of a recoil pad according to a further aspect of the invention.

In a second embodiment, shown in FIGS. 6 and 7, the recoil pad, designated by the reference numeral 101, comprises a base 103, which can be fixed to the stock of a rifle, and a rear member 105, which is rigidly coupled to the base 103.

The material of the element 105 is preferably a polyurethane gel or polyurethane-based gel with a high shock-absorbing power, preferably a polyurethane gel with densities that can vary according to the degree of shock absorption to be given to the butt plate.

Preferably, before pouring the material into the mold cavity, the cavity is coated with a protective coating that will be applied to the outer surface of the butt plate, with a protective function.

The member 105 has an outer surface that is shaped so as to facilitate resting on the shoulder of the shooter when he or she brings the rifle to the firing position to shoot.

The outer surface of the member 105 is contoured so as to adapt anatomically to the shape of the shoulder, particularly of the region of the pectoral muscles and of the deltoid muscle.

As shown more clearly in FIG. 7, the recoil pad 101 includes a snap-acting means 107 for fastening the recoil pad to the rear face of the stock of the rifle. The means is constituted by a contoured member 123 that protrudes from the base 103 and has an enlarged head 125 that is inserted in a corresponding seat formed in the stock of a rifle.

The enlarged head 125 is provided with an angular chamfer 127 in order to facilitate insertion in the seat of the stock.

The recoil pad 101 is preferably manufactured by using a variable-density polyurethane gel both for the base 103 and for the rear member 105, which form a single nondetachable member, producing a substantially monolithic structure.

The recoil pad 101 is produced in a shaped molding cavity, by pouring first the gel with densities that are variable according to the degree of shock absorption to be given to the recoil pad, and then the high-density gel that will form the base 103 for coupling to the stock of the firearm.

The embodiment shown in FIGS. 6 and 7 is particularly useful for fixing the recoil pad 101 to the stock of a firearm made of plastics, for example of the type disclosed in EP-A-0903556, which includes a rear seat provided with an internal raised portion that is suitable to enter the slot formed between the base 103 and the enlarged head 125.

The recoil pad 101 is applied to the stock of a firearm of this kind by elastic deformation of the end portion of the stock.

In practice it has been found that the invention achieves the intended aim and objects, a recoil pad having been provided which is simple from the structural and production standpoint and is at the same time effective from the functional standpoint.

The recoil pad according to the invention is a monolithic body, in which the region that corresponds to the base is rigid enough to ensure solid fixing to the stock and the region that corresponds to the rear member has variable deformability characteristics according to requirements.

The recoil pad according to the invention can be coupled easily and rapidly to the stock of a firearm by the snap-acting fixing means.

The recoil pad according to the invention is susceptible of numerous modifications and variations, within the scope of the appended claims. All the details may be replaced with technically equivalent elements.

The materials employed, as well as the dimensions, may of course be any according to requirements and to the state of the art.

What is claimed is:

1. A recoil pad which can be fixed detachably to the stock of a rifle, comprising a plastic base and a rear member made of deformable material, which is suitable to dissipate the energy transferred to the shoulder by the recoil of the rifle upon firing, wherein said rear member is rigidly coupled to said base so as to form a monolithic body wherein said rear member has a deformability that can vary according to the degree of absorption of the recoil energy that one wishes to give to the recoil pad, further comprising snap acting fixing means for detachably fixing the recoil pad to a rear face of the stock, said snap-acting fixing means comprising at least one pin provided with a fixing member that can engage in a rear part of the stock, said pin having a mushroom-shaped head that is suitable to detachably engage by snap action an elastic means that is disposed within said base.

2. The recoil pad according to claim 1, wherein at least said rear member is made of polyurethane gel or polyurethane-based gel.

3. The recoil pad according to claim 1, wherein said base is made of polyurethane gel or polyurethane-based gel.

4. The recoil pad according to claim 1, wherein said rear member is rigidly coupled to said base and has a molded shape that is contoured.

5. The recoil pad according to claim 1, wherein said rear member is made of gel having a first density and said base is made of a gel having a second density, said second density being greater than said first density.

6. The recoil pad according to claim 1, comprising an outer protective coating that is applied to an outer surface of at least said rear member.

7. The recoil pad according to claim 1, wherein said mushroom-shaped head is provided on a shoulder that protrudes from a cylindrical body of said pin, said mushroom-shaped head protruding from the rear face of the stock when said pin is rigidly coupled to the stock.

8. The recoil pad according to claim 7, wherein said mushroom-shaped head is suitable to be accommodated in a hole formed in said base and comprising said elastic means.

9. The recoil pad according to claim 8, wherein said elastic means comprises a fork-shaped spring, which comprises a substantially circular portion which ends with two arms, said spring being accommodated in a seat formed inside said base at each hole, so that said arms face the hole so that said mushroom-shaped head engages said arms of the fork-shaped spring.

10. A recoil pad which can be fixed detachably to the stock of a rifle, comprising:

a plastic base;

a rear member made of deformable material to dissipate the energy transferred to the shoulder by the recoil of the rifle upon firing, said rear member being rigidly coupled to said base so as to form a monolithic body, said rear member having a deformability selected according to a desired degree of absorption of the recoil energy by the recoil pad; and snap acting fixing means for detachably fixing the recoil pad to a rear face of the stock, said snap-acting fixing means comprising at least one pin provided with a fixing member that can engage in a rear part of the stock, said pin having a mushroom-shaped head that is suitable to detachably engage by snap action an elastic means that is disposed within said base.

* * * * *